US012460526B2

(12) United States Patent
Wakefield

(10) Patent No.: US 12,460,526 B2
(45) Date of Patent: Nov. 4, 2025

(54) INFLOW CONTROL DEVICE

(71) Applicant: Baker Hughes Oilfield Operations LLC, Houston, TX (US)

(72) Inventor: John Wakefield, Cypress, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 108 days.

(21) Appl. No.: 18/473,545

(22) Filed: Sep. 25, 2023

(65) Prior Publication Data

US 2025/0101847 A1 Mar. 27, 2025

(51) Int. Cl.
*E21B 43/38* (2006.01)

(52) U.S. Cl.
CPC ..... *E21B 43/38* (2013.01)

(58) Field of Classification Search
CPC ..... E21B 43/38
See application file for complete search history.

(56) References Cited

U.S. PATENT DOCUMENTS 5,083,613 A * 1/1992 Gregoli ..... E21B 43/121 166/305.1
7,942,206 B2 5/2011 Huang et al.
9,506,320 B2 11/2016 Dykstra et al.
10,145,223 B2 12/2018 Moen et al.
11,111,756 B2 9/2021 Killie et al.
11,613,961 B2 3/2023 Malkawi et al.
2019/0120048 A1* 4/2019 Coffin ..... G01N 33/2823
2019/0178068 A1* 6/2019 Stolboushkin ..... E21B 43/12
2020/0208496 A1* 7/2020 Veselka ..... E21B 43/086

* cited by examiner

*Primary Examiner* — David Carroll

(74) *Attorney, Agent, or Firm* — Baker Hughes Patent Organization

(57) ABSTRACT

An inflow control device, including an upstream flow control structure configured to induce water droplet collisions, and a downstream flow control structure disposed downstream of the upstream flow control structure and comprising a channel formed therethrough. A method of controlling flow including flowing a fluid from a source to a destination through an inflow control device comprising an upstream flow control structure and a downstream flow control structure disposed downstream of the upstream flow control structure and comprising a channel formed therethrough, and inducing water droplet collisions in the upstream flow control structure. A wellbore system including a borehole in a subsurface formation, a string disposed in the borehole, and the inflow control device, disposed within or as part of the string.

18 Claims, 11 Drawing Sheets

INFLOW CONTROL DEVICE

BACKGROUND

In the resource recovery and fluid sequestration industries, especially in mature wells, the target fluid may include a greater percentage of water than might be desired. Inflow control devices may be disposed in the well to exclude higher water percentage fluids while allowing lower water percentage fluids to flow into the borehole.

SUMMARY

An embodiment of an inflow control device, including an upstream flow control structure configured to induce water droplet collisions, and a downstream flow control structure disposed downstream of the upstream flow control structure and comprising a channel formed therethrough.

An embodiment of a method of controlling flow including flowing a fluid from a source to a destination through an inflow control device comprising an upstream flow control structure and a downstream flow control structure disposed downstream of the upstream flow control structure and comprising a channel formed therethrough, and inducing water droplet collisions in the upstream flow control structure.

An embodiment of a wellbore system including a borehole in a subsurface formation, a string disposed in the borehole, and the inflow control device, disposed within or as part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
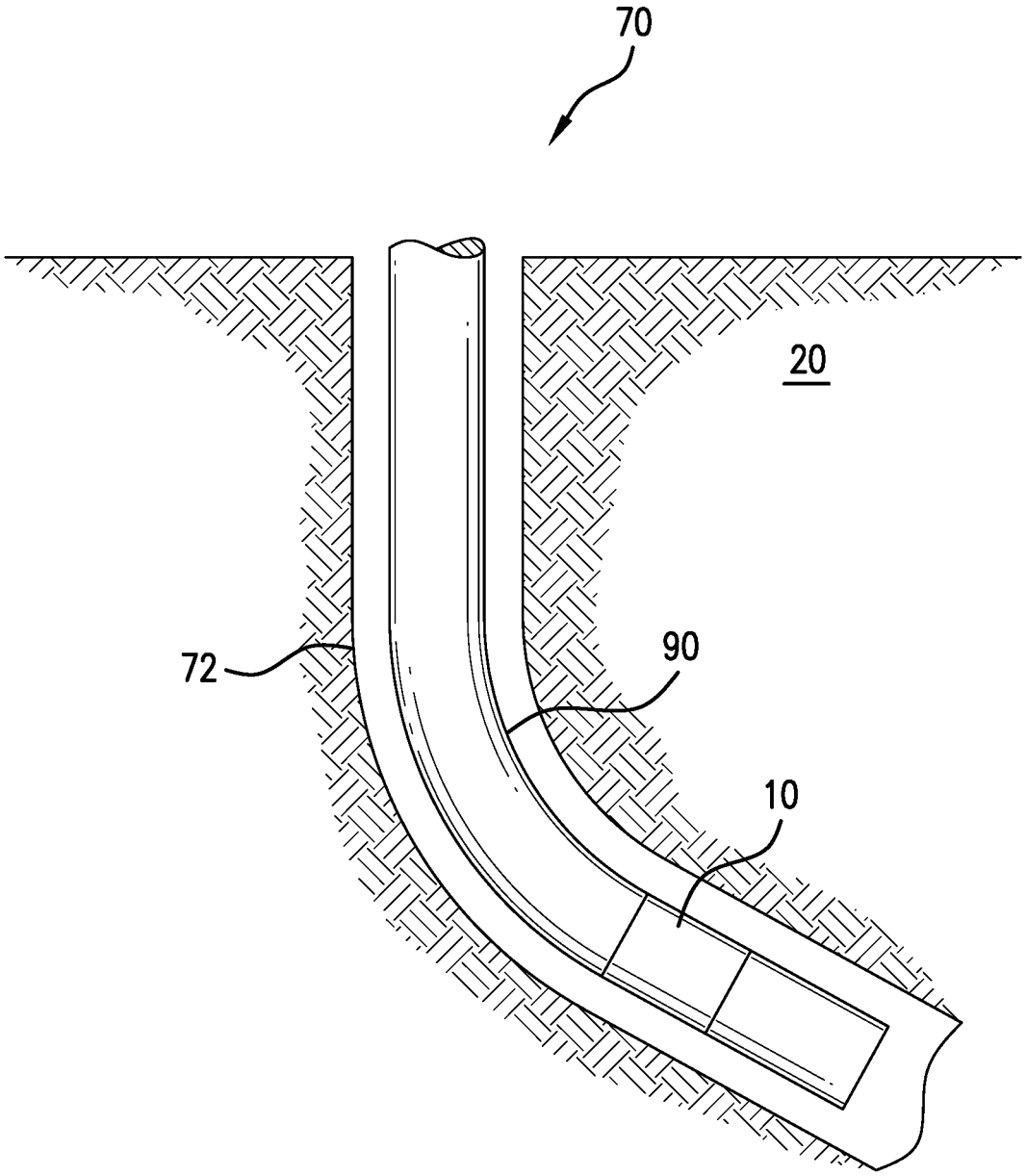
FIG. 1 shows a schematic view of a borehole system including an inflow control device according to one or more embodiments.

FIG. 1 shows a schematic view of a wellbore system 70 according to one or more embodiments. The wellbore system 70 includes a borehole 72 in a subsurface formation 20. Disposed within the borehole 72 is a string 90. An inflow control device 10 according to one or more embodiments is disposed within or as a part of the string 90.

FIGS. 2A-4C illustrate embodiments of an inflow control device 10. The inflow control device 10 may be disposed within a housing 95. The housing 95 may be disposed within or may form part of the string 90 of the borehole system 70. The housing 95 defines a flowpath 50 therein, including an inlet 51 and an outlet 53. According to an embodiment, the housing 95 may be part of the string 90 such that the flowpath 50 extends from an outer surface of a wall of the string 90 to an inner surface of the wall of the string 90 in a radial direction thereof, for example, orthogonally or at another angle relative to a longitudinal axis of string 90. Alternatively, the housing 95 may be formed within an inside diameter (I.D.) of the string 90 such that the flowpath 50 runs within the I.D. of the string 90. In other embodiments, the flowpath 50 may be formed in alternate structure including a housing 95 that is connected to the string 90. Fluid extracted from the formation 20, which may be a mixture of oil 30 and water 40, enters the flowpath 50 from the inlet 51 and exits the flowpath 50 from the outlet 53.

Figure 2A:
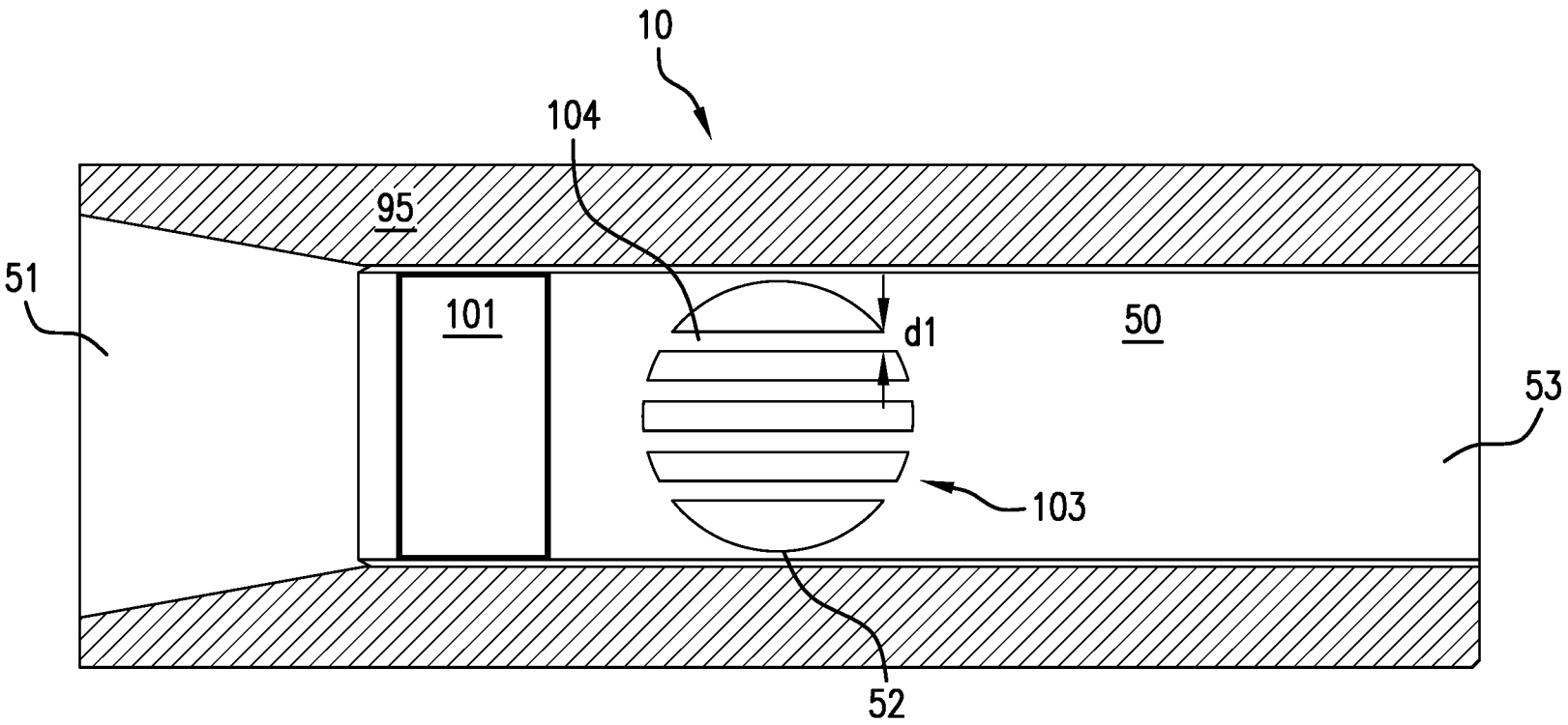
FIG. 2A shows a schematic view of an inflow control device according to an embodiment.

FIG. 2A shows a schematic view of an inflow control device 10 according to an embodiment. The inflow control device 10 includes an upstream flow control structure 101 and a downstream flow control structure 103. Examples of the upstream flow control structure 101 include a flow baffle (described below with reference to FIG. 3A), opposing jets (described below with reference to FIG. 3B), and/or porous media (described below with reference to FIGS. 4A-4C). A throat 52 of the flowpath 50 is defined between an outer surface of the downstream flow control structure 103 and an inner surface of the housing 95. According to one or more embodiments, the throat 52 is defined as an area of the flowpath 50 where the inflow control device 10 is disposed having a minimum flow area. For example, the throat 52 may have a width of 100 μm. According to one or more embodiments, the throat 52 may have a width between 80 μm and 120 μm. According to one or more embodiments, the throat 52 may have a width between 90 μm and 110 μm.

The downstream control structure 103 includes a plurality of channels 104 formed therethrough in the direction of flow of the flowpath 50. When viewed in a direction orthogonal to flow of the flowpath 50, the downstream flow control structure 103 may be a circular structure, and the channels 104 may extend linearly in the flow direction from a leading edge surface of the downstream flow control structure 103 to a trailing edge surface of the downstream flow control structure 103. For example, the channels 104 may have a diameter d1 of 100 μm. According to one or more embodiments, the channels 104 may have a diameter d1 between 80 μm and 120 μm. According to one or more embodiments, the channels 104 may have a diameter d1 between 90 μm and 110 μm. According to one or more embodiments, the downstream control structure 103 may include one channel 104 that may have a diameter d1 between 900 μm and 1100 μm.

Figure 2B:
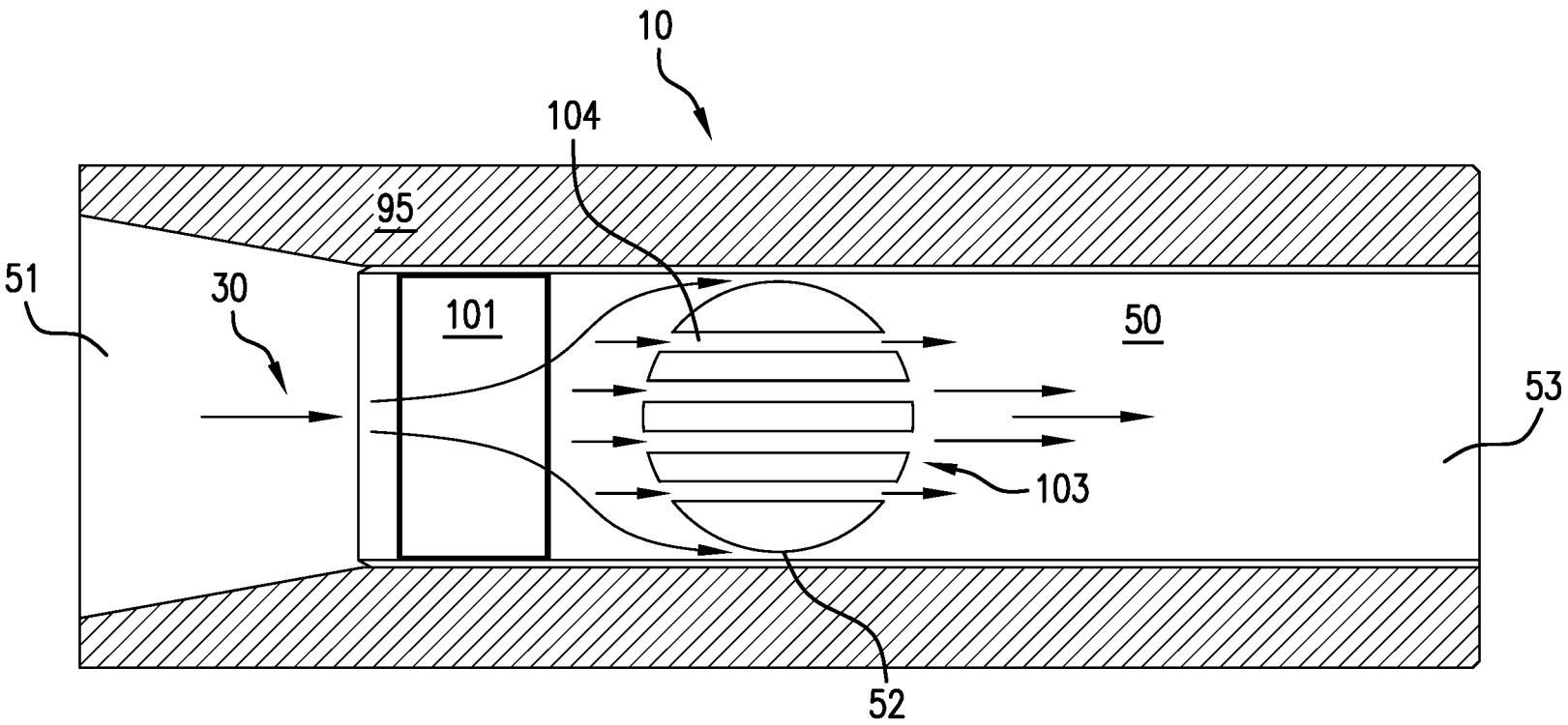
FIG. 2B shows a schematic view of the inflow control device of FIG. 2A showing a flow of oil therethrough.
Figure 2C:
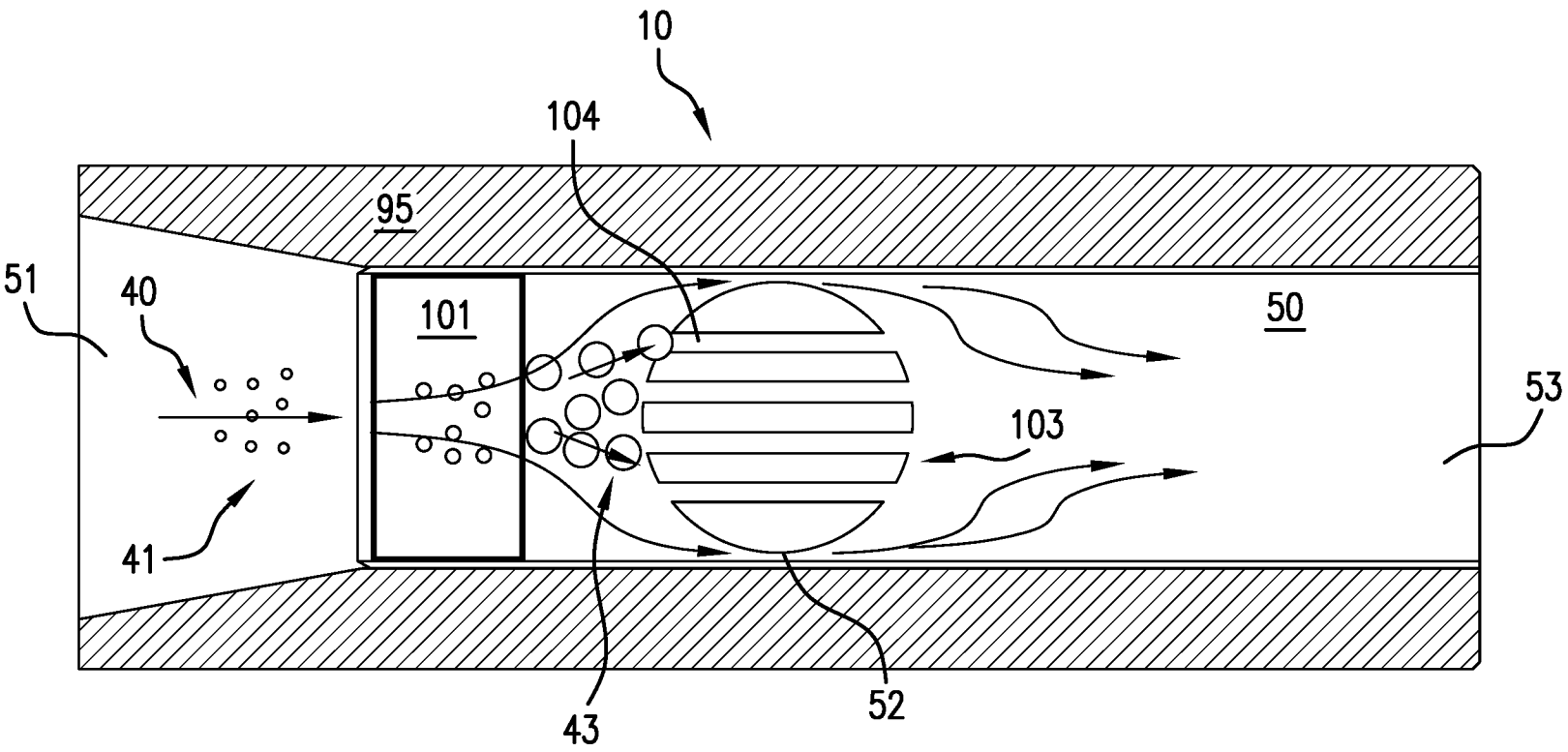
FIG. 2C shows a schematic view of the inflow control device of FIG. 2A showing a flow of water therethrough.

FIG. 2B shows a schematic view of oil 30 passing through the inflow control device 10, and FIG. 2C shows a schematic view of oil 30 passing through the inflow control device 10. As shown in FIG. 2B, the upstream flow control structure 101 is structured such that droplet sizes of oil 30 passing therethrough are not affected. Thus, some portion of oil 30 passes through the channels 104 while the remainder passes around the downstream flow control structure 103 such that, as shown in FIG. 2B, the oil 30 is organized and diffused while flowing through the inflow control device 10.

As shown in FIG. 2C, the upstream flow control structure 101 is structured to induce water droplet collisions and coalescence to increase water droplet size of the water 40 flowing therethrough. That is, as shown in FIG. 2C, the water 40 enters the inlet 51 of the flowpath 50 as small droplets 41 and undergoes water droplet collisions and coalescence within the upstream flow control structure 101 such that the water 40 exits the upstream flow control structure 101 as large droplets 43. For example, the upstream flow control structure 101 may form large droplets 43 having a diameter of around 100 μm. For example, the upstream flow control structure 101 may form large droplets 43 having a diameter between 80 μm and 120 μm. For example, the upstream flow control structure 101 may form large droplets 43 having a diameter between 90 μm and 110 μm. According to one or more embodiments, the upstream flow control structure 101 is structured to form large droplets 43 having a similar diameter as a diameter d1 of the channels 104 of the downstream flow control structure 103. According to one or more embodiments, the upstream flow control structure 101 is structured to form large droplets 43 having a diameter greater than a diameter d1 of the channels 104 of the downstream flow control structure 103. According to one or more embodiments, the upstream flow control structure 101 is structured to form large droplets 43 having a similar diameter as a width of the throat 52. According to one or more embodiments, the upstream flow control structure 101 is structured to form large droplets 43 having a greater diameter than a width of the throat 52.

Due to the large droplets 43 formed by the upstream flow control structure 101, the water 40 in the flowpath 50 may be impeded from traveling through the channels 104 of the downstream flow control structure 103 and/or the throat 52. That is, as the channels 104 formed in the downstream flow control structure 103 may have diameters d1 that are similar to or less than diameters of the large droplets 43, and the throat 52 may have a width that is similar to or less than diameters of the large droplets 43, the water 40 may be impeded from passing through the channels 104 of the downstream flow control structure 103 and/or the throat 52.

In order to form the large droplets 43 at the upstream flow control structure 101, the water 40 may be maintained at a low Reynolds number to prevent shear of the droplets of the water 40. According to an embodiment, a flow velocity reducing structure may be added upstream of the upstream flow control structure 101 to reduce the Reynolds number. According to an embodiment, a flow velocity reducing structure may be incorporated into the upstream flow control structure 101.

Figure 3A:
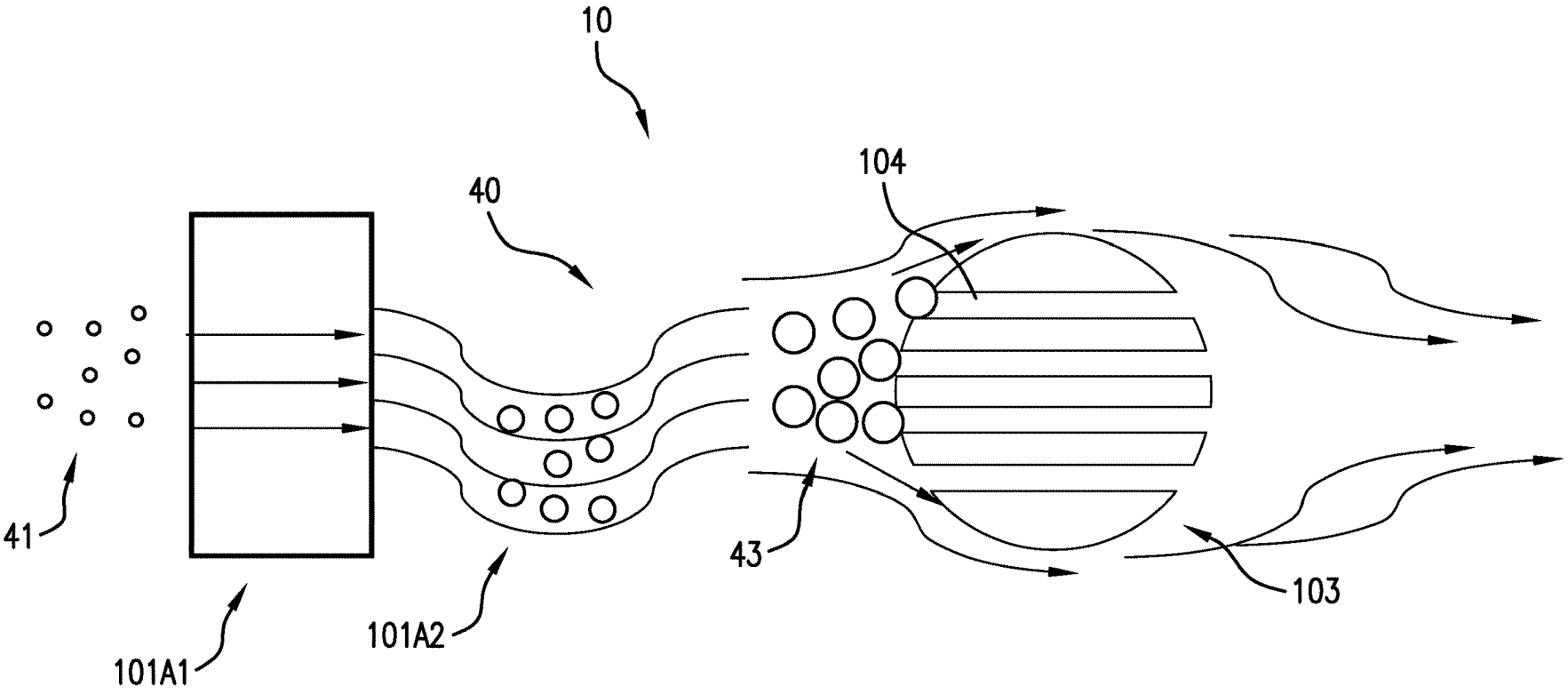
FIG. 3A shows a schematic view of an inflow control device according to an embodiment showing a flow of water therethrough.

FIG. 3A shows a schematic view of an inflow control device 10 according to an embodiment showing a flow of water 40 therethrough. The inflow control device 10 is similar to that shown in FIG. 2A but has an upstream flow control structure in the form of a pressure-dropping structure 101A and a flow baffle 101A2. According to an embodiment, the inflow control device 10 may include the flow baffle 101A2 without the pressure-dropping structure 101A1. The pressure-dropping structure 101A1 may be, for example, a nozzle or other pressure-dropping devices that slow droplet velocities of the water 40 prior to entering the flow baffle 101A2 to reduce the Reynolds number of the water 40 and reduce or prevent shearing.

The flow baffle 101A2 is structured such that droplet sizes of oil 30 passing therethrough are not affected. Thus, some portion of oil 30 passes through the channels 104 while the remainder passes around the downstream flow control structure 103 such that the oil 30 is organized and diffused while flowing through the inflow control device 10. The flow baffle 101A2 is structured to organize and slow streamlines of the water 40 and induce water droplet collisions and coalescence to increase droplet sizes of the water 40 flowing therethrough. That is, as shown in FIG. 3A, the water 40 enters the flow baffle 101A2 as small droplets 41 and undergoes water droplet collisions and coalescence such that the water 40 exits the flow baffle 101A2 as large droplets 43. For example, the flow baffle 101A2 may form large droplets 43 having a diameter of around 100 μm. For example, the flow baffle 101A2 may form large droplets 43 having a diameter between 80 μm and 120 μm. For example, the flow baffle 101A2 may form large droplets 43 having a diameter between 90 μm and 110 μm. According to one or more embodiments, the flow baffle 101A2 is structured to form large droplets 43 having a similar diameter as a diameter d1 of the channels 104 of the downstream flow control structure 103. According to one or more embodiments, the flow baffle 101A2 is structured to form large droplets 43 having a diameter greater than a diameter d1 of the channels 104 of the downstream flow control structure 103. According to one or more embodiments, the flow baffle 101A2 is structured to form large droplets 43 having a similar diameter as a width of the throat 52. According to one or more embodiments, the flow baffle 101A2 is structured to form large droplets 43 having a greater diameter than a width of the throat 52.

Figure 3B:
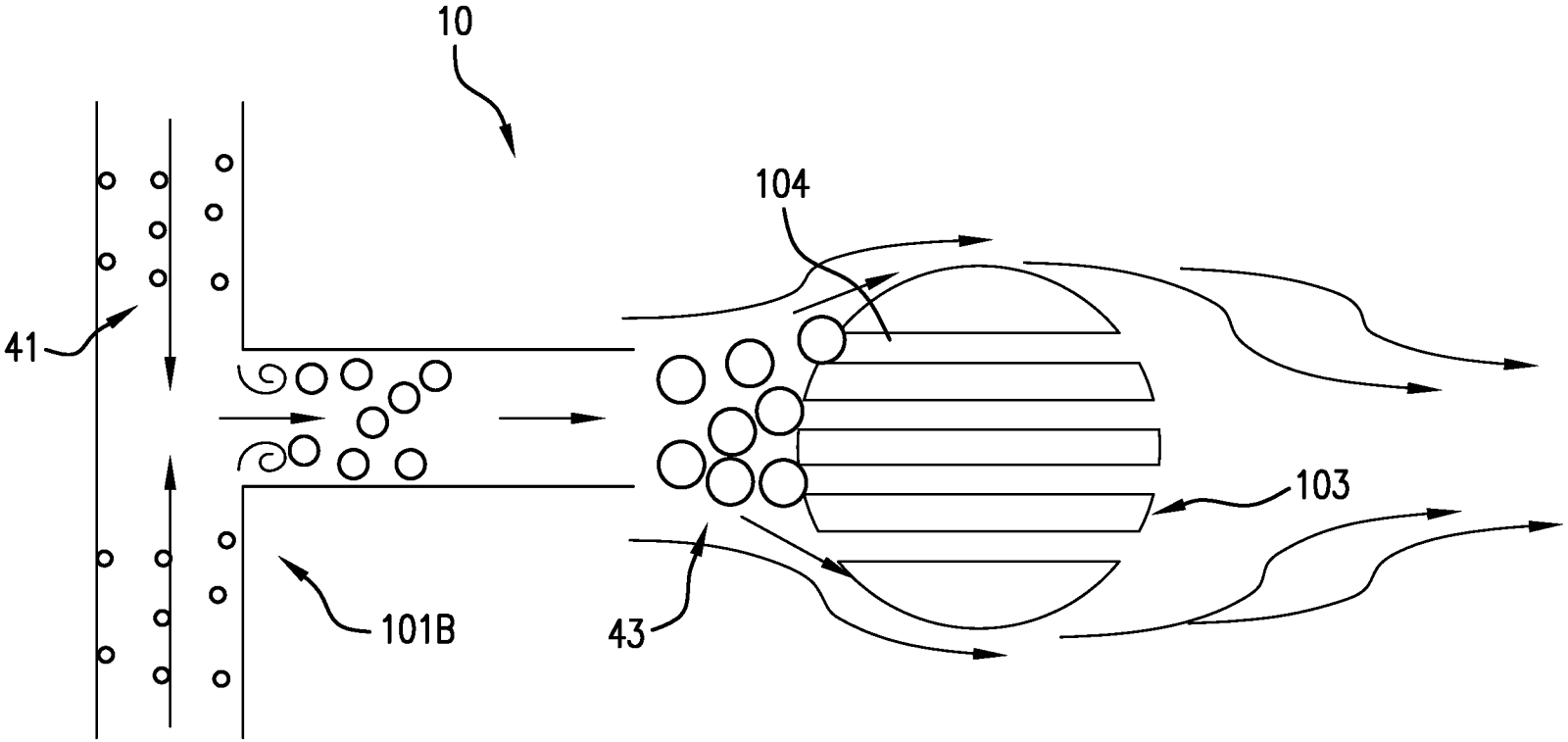
FIG. 3B shows a schematic view of an inflow control device according to an embodiment showing a flow of water therethrough.

FIG. 3B shows a schematic view of an inflow control device 10 according to an embodiment showing a flow of water 40 therethrough. The inflow control device 10 is similar to that shown in FIG. 2A but has an upstream flow control structure in the form of a direct flow device that increases collisions of the droplets of the water 40. As shown in FIG. 3B, the direct flow device may be, for example, impinging jets 101B. The direct flow device may increase contact between droplets of the water 40 so as to induce collisions and coalescence to form large water droplets 43 from the small water droplets 41. While FIG. 3B shows impinging jets 101B that create contact, according to an embodiment, contact may be created by gravity.

The impinging jets 101B are structured such that droplet sizes of oil 30 are not affected. Thus, some portion of oil 30 passes through the channels 104 while the remainder passes around the downstream flow control structure 103 such that the oil 30 is organized and diffused while flowing through the inflow control device 10. The impinging jets 101B directly induce water droplet collisions in the water 40 to induce coalescence and increase droplet sizes of the water 40 flowing therethrough. That is, as shown in FIG. 3B, the water 40 enters the impinging jets 101B as small droplets 41 and undergoes water droplet collisions and coalescence such that the water 40 exits the impinging jets 101B as large droplets 43. The Reynolds number of water 40 in the impinging jets 101B is maintained sufficiently low so as to suppress or prevent shearing of the droplets. For example, the impinging jets 101B may form large droplets 43 having a diameter of around 100 μm. For example, the impinging jets 101B may form large droplets 43 having a diameter between 80 μm and 120 μm. For example, the impinging jets 101B may form large droplets 43 having a diameter between 90 μm and 110 μm. According to one or more embodiments, the impinging jets 101B may form large droplets 43 having a similar diameter as a diameter d1 of the channels 104 of the downstream flow control structure 103. According to one or more embodiments, the impinging jets 101B may form large droplets 43 having a diameter greater than a diameter d1 of the channels 104 of the downstream flow control structure 103. According to one or more embodiments, the impinging jets 101B may form large droplets 43 having a similar diameter as a width of the throat 52. According to one or more embodiments, the impinging jets 101B may form large droplets 43 having a greater diameter than a width of the throat 52.

Figure 4A:
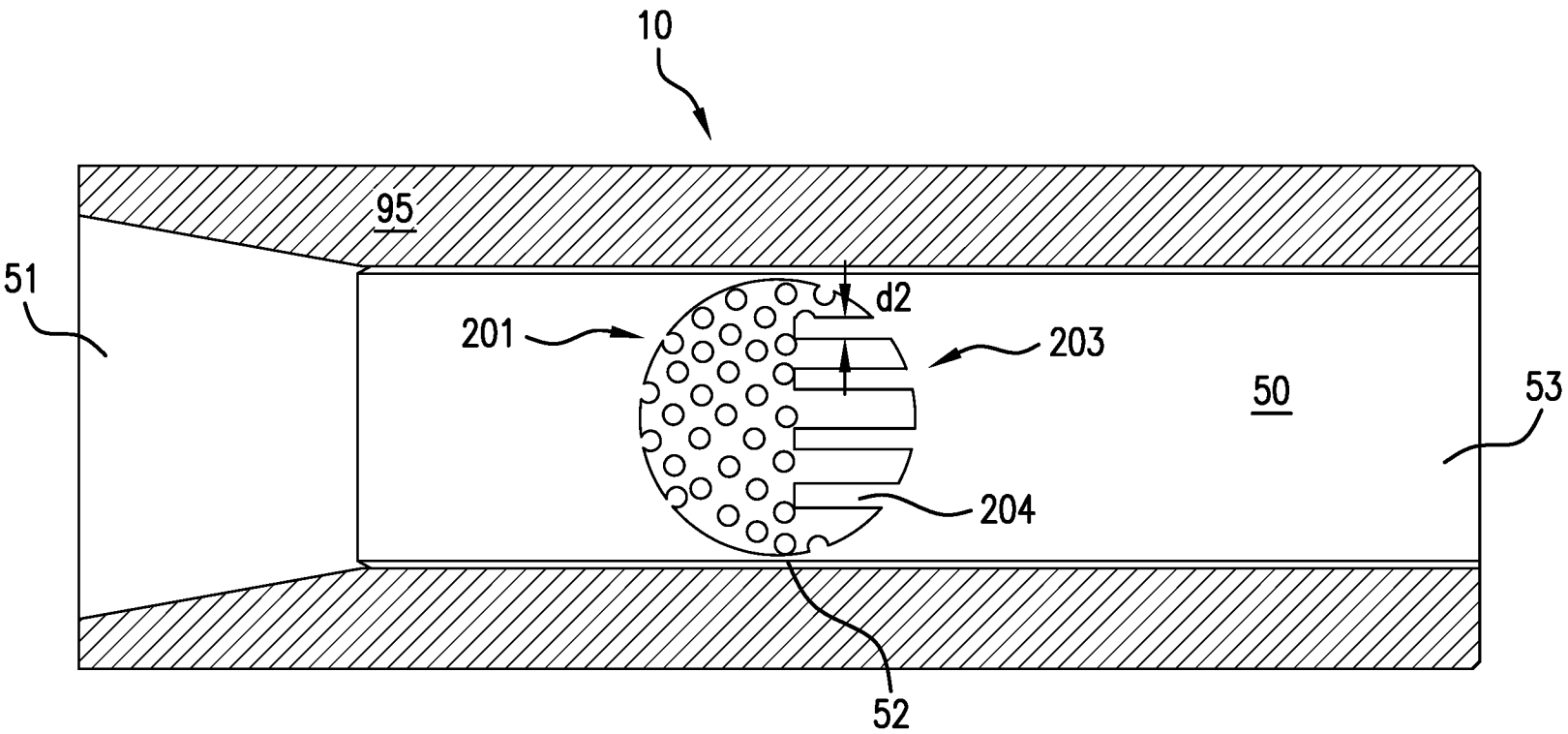
FIG. 4A shows a schematic view of an inflow control device according to an embodiment.

FIG. 4A shows a schematic view of an inflow control device 10 according to an embodiment. The inflow control device 10 includes an upstream flow control structure 201 and a downstream flow control structure 203. A throat 52 of the flowpath 50 is defined between an outer surface of the upstream flow control structure 201 and an inner surface of the housing 95. According to one or more embodiments, the throat 52 is defined as an area of the flowpath 50 where the inflow control device 10 is disposed having a minimum flow area. For example, the throat 52 may have a width of 100 μm. According to one or more embodiments, the throat 52 may have a width between 80 μm and 120 μm. According to one or more embodiments, the throat 52 may have a width between 90 μm and 110 μm.

The upstream flow control structure 201 and the downstream flow control structure 203 may be formed integrally as a circular-shaped structure when view in a direction orthogonal to the flow direction of the flowpath 50. That is, the upstream flow control structure 201 and the downstream flow control structure 203 are formed as a unitary structure that is a circle. The upstream flow control structure 201 includes pores formed in the circle so as to be a porous structure. The upstream flow control structure 201 may extend past the position of the throat 52 of the flowpath. The upstream flow control structure 201 may include a plurality of pores that, near an outer surface of the circle, extends further downstream than a center of the circle.

The downstream control structure 203 includes a plurality of channels 204 formed therethrough in the direction of flow of the flowpath 50. The channels 204 may extend linearly in the flow direction from a downstream end of the upstream flow control structure 201 to a downstream end of the downstream flow control structure 203. For example, the channels 204 may have a diameter d1 of 100 μm. According to one or more embodiments, the channels 204 may have a diameter d1 between 80 μm and 120 μm. According to one or more embodiments, the channels 204 may have a diameter d1 between 90 μm and 110 μm.

Figure 4B:
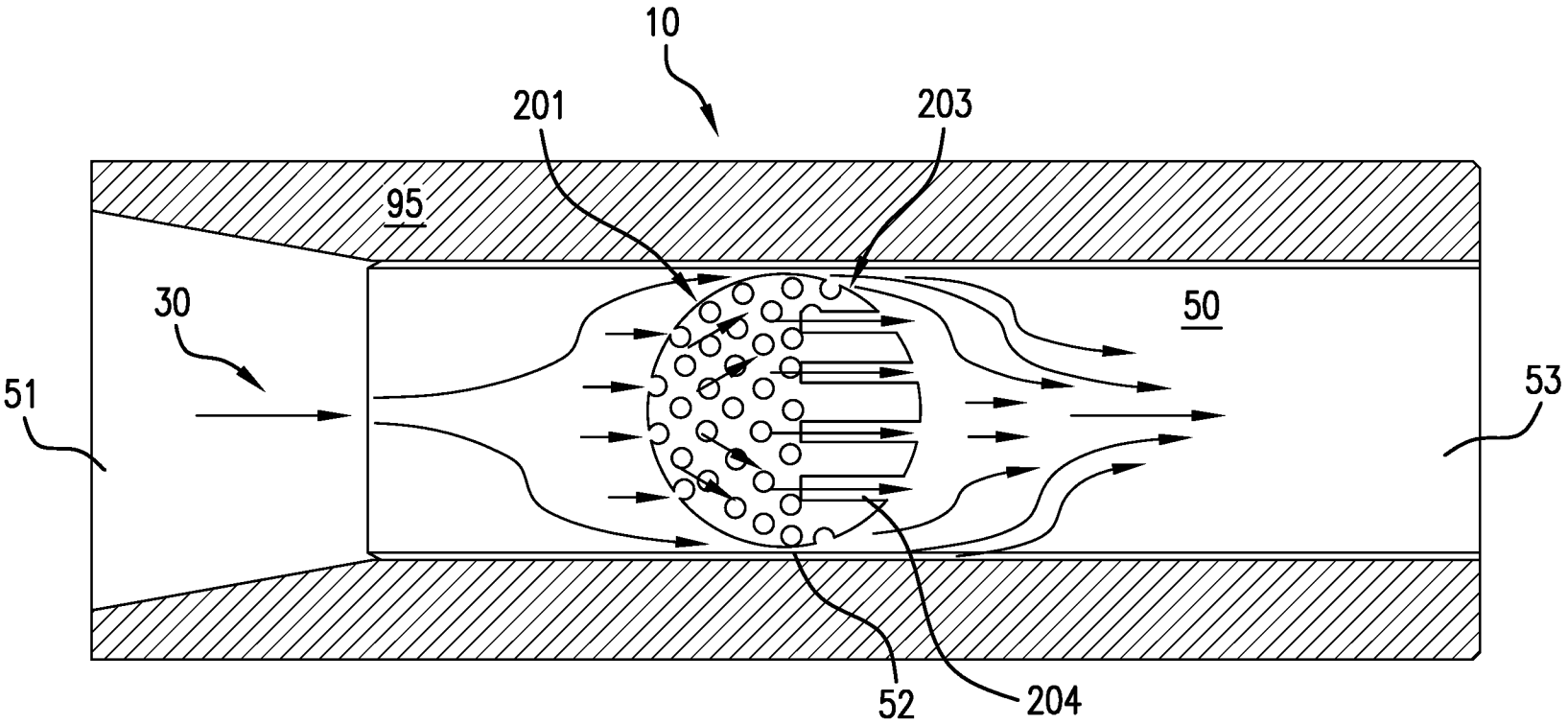
FIG. 4B shows a schematic view of the inflow control device of FIG. 4A showing a flow of oil therethrough.

FIG. 4B shows oil 30 passing through the inflow control device 10. While some of the oil 30 passes through the throat 52, the upstream flow control structure 201 allows the oil 30 to pass therethrough such that at least a portion of the oil 30 flows within the upstream flow control structure 201 to an area downstream of the throat 52 while other portions pass through the channels 204 of the downstream flow control structure 203. Thereafter, the oil 30 flows towards the outlet 53 of the flowpath 50.

Figure 4C:
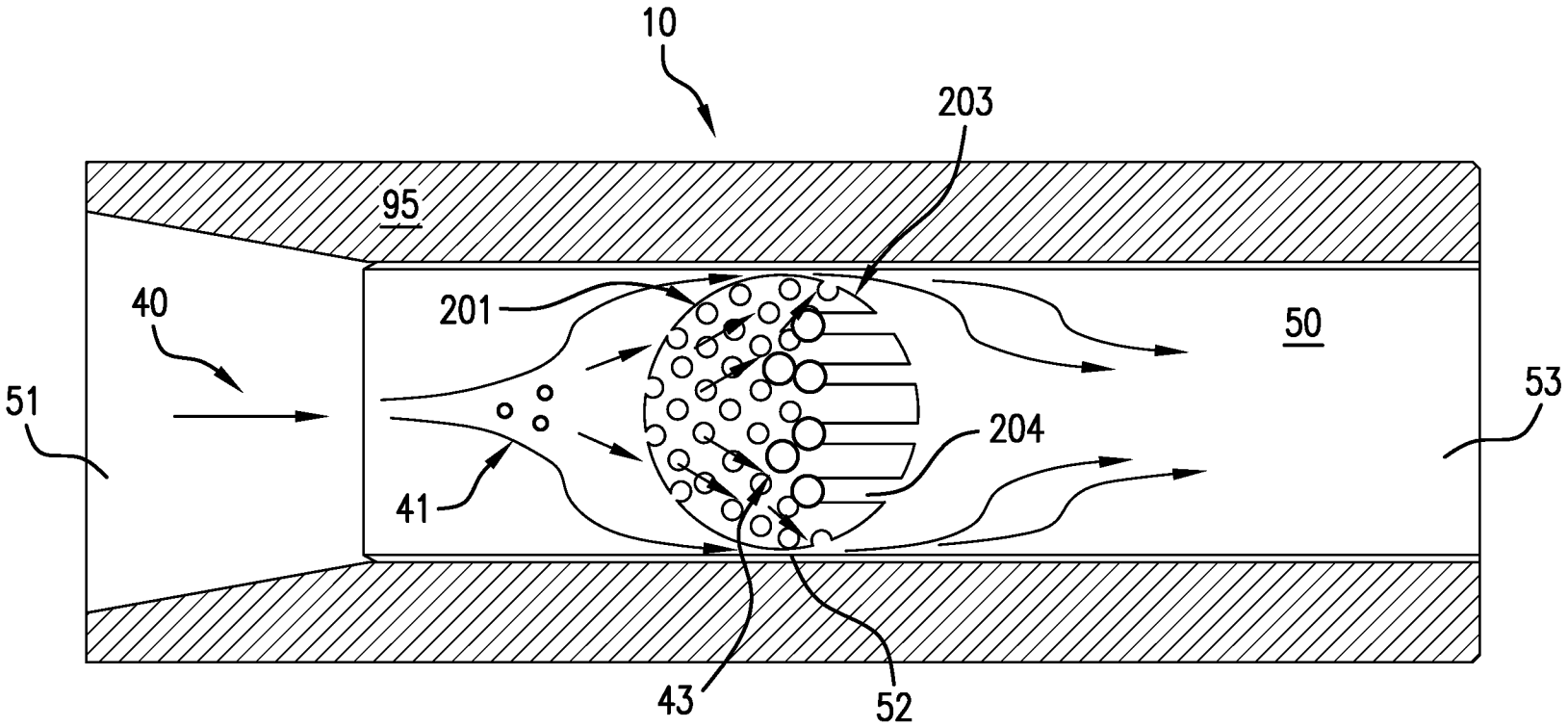
FIG. 4C shows a schematic view of the inflow control device of FIG. 4A showing a flow of water therethrough.

FIG. 4C shows water 40 passing through the inflow control device 10. While some of the water 40 passes through the throat 52, the upstream flow control structure 201 allows water 30 to pass therethrough such that at least a portion of the water 40 flows within the upstream flow control structure 201. The pores in the upstream control structure 201 are sized such that the water 40 is slowed down and the flow thereof is squeezed to increase water droplet collisions and coalescence, increasing droplet sizes of the water 40. The upstream flow control structure 201 may induce flow that undergoes repeated acceleration and deceleration of droplets of the water 40, creating more opportunities for collisions and coalescence. Thus, as shown in FIG. 4C, the water 40 enters the inlet 51 of the flowpath 50 as small droplets 41 and undergoes water droplet collisions and coalescence within the upstream flow control structure 201 such that the water 40 exits the upstream flow control structure 201 as large droplets 43.

For example, the upstream flow control structure 201 may form large droplets 43 having a diameter of around 100 μm. For example, the upstream flow control structure 201 may form large droplets 43 having a diameter between 80 μm and 120 μm. For example, the upstream flow control structure 201 may form large droplets 43 having a diameter between 90 μm and 110 μm. According to one or more embodiments, the upstream flow control structure 201 is structured to form large droplets 43 having a similar diameter as a diameter d2 of the channels 104 of the downstream flow control structure 203. According to one or more embodiments, the upstream flow control structure 201 is structured to form large droplets 43 having a diameter greater than a diameter d2 of the channels 204 of the downstream flow control structure 203.

Due to the large droplets 43 formed by the upstream flow control structure 201, the water 40 in the flowpath 50 may be impeded from traveling through the channels 204 of the downstream flow control structure 203. That is, as the channels 204 formed in the downstream flow control structure 203 may have diameters d2 that are similar to or less than diameters of the large droplets 43, the water 40 may be impeded from passing through the channels 204 of the downstream flow control structure 203. The water 40 passing through the flow control structure 201 may be slowed down in the pores, while the water 40 passing through the throat 52 may be sped up and brought in closer contact, creating a large pressure drop to slow the flow of the water 40.

In order to form the large droplets 43 at the upstream flow control structure 201, the water 40 may be maintained at a low Reynolds number to prevent shear of the droplets in the water 40. According to an embodiment, a flow velocity reducing structure may be added upstream of the upstream flow control structure 201 to reduce the Reynolds number. According to an embodiment, a flow velocity reducing structure may be incorporated into the upstream flow control structure 201.

Figure 5A:
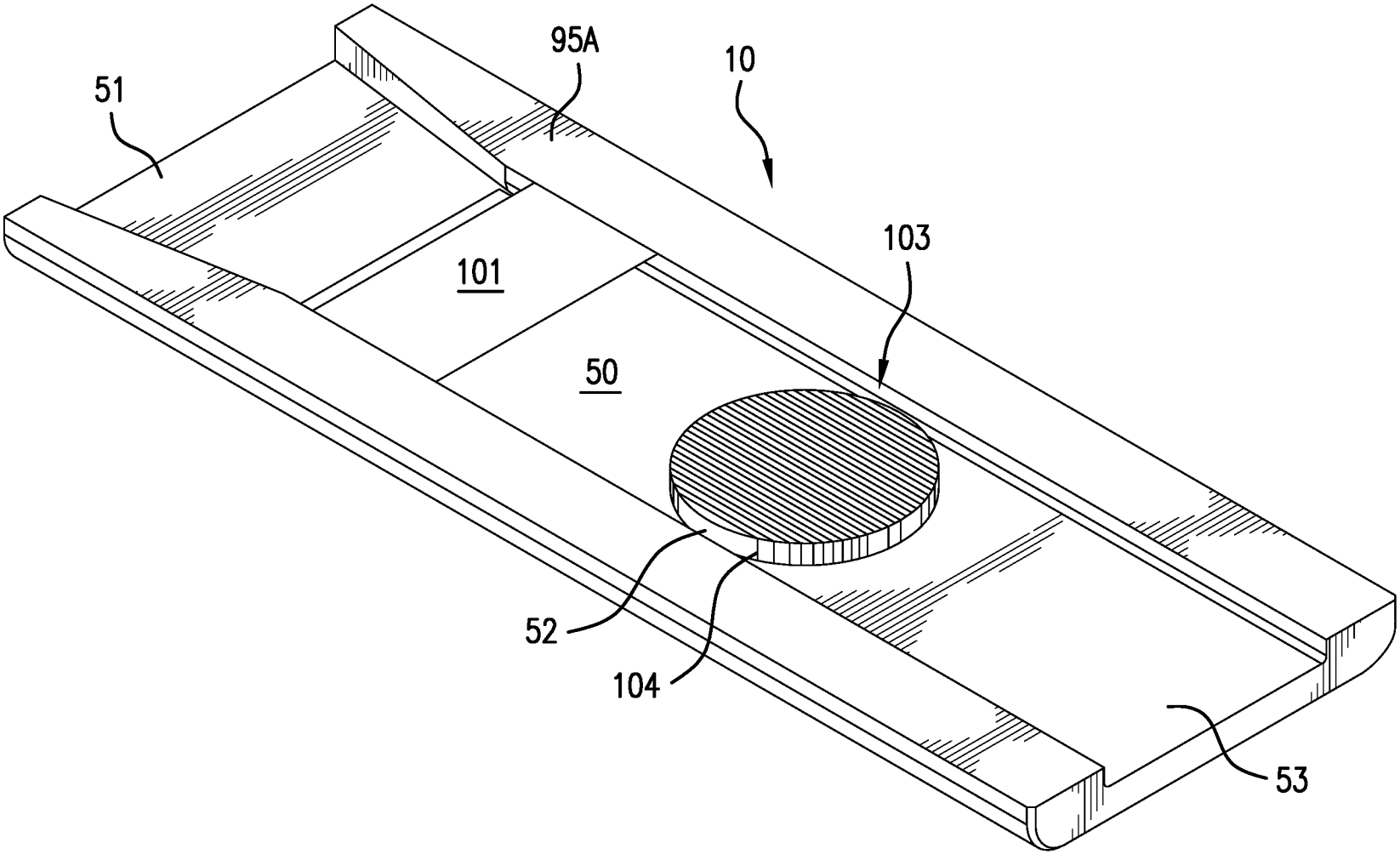
FIG. 5A shows a perspective view of a first partial housing that forms part of the housing and inflow control device shown in FIGS. 2A-2C.
Figure 5B:
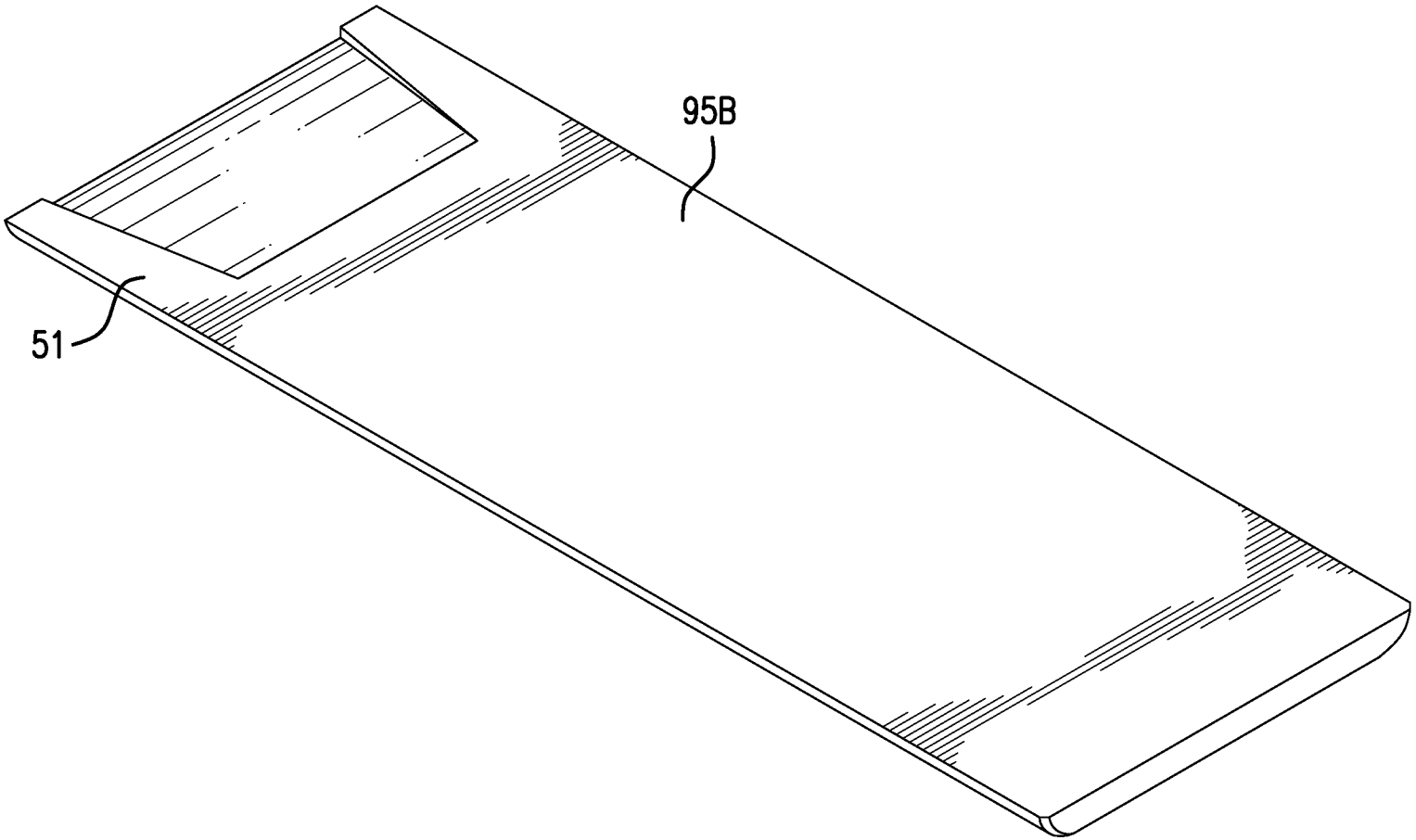
FIG. 5B shows a perspective view of a second partial housing that forms part of the housing and inflow control device shown in FIGS. 2A-2C.

FIGS. 5A and 5B show perspective views of a first partial housing 95A and a second partial housing 95B that are combined to form the housing 95 shown in FIGS. 2A-2C according to a non-limiting example. The second partial housing 95B may be disposed atop the first partial housing 95A to form the flowpath 50 and the inflow control device 10 therebetween. As shown in FIGS. 5A-5B, the flowpath 50 has a rectangular cross-section when viewed in a direction of flow of the flowpath 50, and the inflow control device 10 extends from a surface of the housing 95 defining the flowpath 50. The terminal end surfaces of the inflow control device 10 that face the second partial housing 95B may be flush with the second partial housing 95B such that there is no gap therebetween. That is, within a plane orthogonal to both the flow direction of the flowpath 50 and the plane shown in FIGS. 2A-2C, the inflow control device 10 and the flowpath 50 may have equal dimensions. The inflow control device 10 may be formed as a unitary structure with the first partial housing 95A.

While FIGS. 5A and 5B show an embodiment of the inflow control device 10 shown in FIGS. 2A-2C, a person of ordinary skill in the art would understand that the embodiments of the inflow control device 10 shown in FIGS. 3A-4C may be formed on a similar housing 95 such that the flowpath 50 is rectangular in a direction of flow thereof, and the inflow control device 10 extends similarly from a surface defining the flowpath 50.

While FIGS. 5A and 5B show first and second partial housings 95A, 95B that are brought together to form the flowpath 50 and the inflow control device 10, the flowpath 50 and the inflow control device 10 may instead be formed in a unitary housing 95 that may be manufactured, for example, via 3D printing.

Furthermore, while FIGS. 5A and 5B show the first and second partial housings 95A, 95B forming a rectangular flowpath 50 and a correspondingly shaped inflow control device 10 when viewed in the direction of flow of the flowpath 50, the housing 95 may instead be structured to have a cylindrical flowpath 50 formed therein such that the flowpath 50 may be circular when viewed in the direction of flow of the flowpath 50. In this case, the inflow control device may have an annular shape.

As described above, the inflow control devices 10 shown in FIGS. 1-5B may discourage higher water percentage fluids while allowing lower water percentage fluids to flow more freely. Thus, flow of fluid with high water concentration tends to flow slower than fluid with low water concentration.

While specific ranges of the diameters of the large droplets 43 are discussed above, a person of ordinary skill in the art would understand that water droplets do not form with uniform diameters. According to an embodiment, the aforementioned diameter of the large droplets 43 exiting the upstream flow control structure 101 is an average diameter. According to an embodiment, the aforementioned diameter of the large droplets 43 exiting the upstream flow control structure 101 is a minimum diameter. According to an embodiment, the aforementioned diameter of the large droplets 43 exiting the upstream flow control structure 101 is a minimum diameter for a specific percentage of the water 40 exiting the upstream flow control structure 101. According to one or more embodiments, the specific percentage may be 90% or more. According to one or more embodiments, the specific percentage may be 80% or more. According to one or more embodiments, the specific percentage may be 70% or more. According to one or more embodiments, the specific percentage may be 60% or more. According to one or more embodiments, the specific percentage may be 50% or more.

Embodiment 1: An inflow control device, including an upstream flow control structure configured to induce water droplet collisions, and a downstream flow control structure disposed downstream of the upstream flow control structure and comprising a channel formed therethrough.

Embodiment 2: The inflow control device as in any prior embodiment, wherein the channel is sized to allow oil to pass therethrough.

Embodiment 3: The inflow control device as in any prior embodiment, wherein the upstream flow control structure is configured to induce water droplet collisions to form water droplets that have a diameter equal to or greater than a diameter of the channel.

Embodiment 4: The inflow control device as in any prior embodiment, wherein the upstream flow control structure comprises a plurality of impinging jets.

Embodiment 5: The inflow control device as in any prior embodiment, wherein the upstream flow control structure comprises a flow baffle.

Embodiment 6: The inflow control device as in any prior embodiment, wherein the upstream flow control structure comprises a pressure-dropping structure upstream of the flow baffle.

Embodiment 7: The inflow control device as in any prior embodiment, wherein the pressure-dropping structure comprises a nozzle.

Embodiment 8: The inflow control device as in any prior embodiment, wherein the upstream flow control structure comprises a plurality of pores.

Embodiment 9: The inflow control device as in any prior embodiment, wherein the upstream flow control structure and the downstream flow control structure are formed as a unitary structure.

Embodiment 10: The inflow control device as in any prior embodiment, wherein the downstream flow control structure has a circular cross-section in a plane perpendicular to a direction of flow.

Embodiment 11: The inflow control device as in any prior embodiment, wherein the channel has a diameter between 80 μm and 120 μm.

Embodiment 12: The inflow control device as in any prior embodiment, further comprising a flow velocity reducing structure disposed upstream of the upstream flow control structure and configured to reduce a Reynolds number of flow passing therethrough.

Embodiment 13: A method of controlling flow including flowing a fluid from a source to a destination through an inflow control device comprising an upstream flow control structure and a downstream flow control structure disposed downstream of the upstream flow control structure and comprising a channel formed therethrough, and inducing water droplet collisions in the upstream flow control structure.

Embodiment 14: The method as in any prior embodiment, wherein the fluid comprises a mixture of oil and water.

Embodiment 15: The method as in any prior embodiment, wherein the inducing water droplet collisions in the upstream flow control structure forms water droplets having a diameter equal to or greater than a diameter of the channel.

Embodiment 16: The method as in any prior embodiment, further including flowing the fluid into the upstream flow control structure at a Reynolds number that is lower than a threshold at which water droplets within the upstream flow control structure undergo shearing.

Embodiment 17: The method as in any prior embodiment, wherein the upstream flow control structure comprises a plurality of impinging jets.

Embodiment 18: The method as in any prior embodiment, wherein the upstream flow control structure comprises a flow baffle.

Embodiment 19: The method as in any prior embodiment, wherein the upstream flow control structure and the downstream flow control structure are formed as a unitary structure.

Embodiment 20: A wellbore system including a borehole in a subsurface formation, a string disposed in the borehole, and the inflow control device as in any prior embodiment, disposed within or as part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value. As used herein, the term "unitary" is defined as being formed as a single undivided continuous structure and not from combining separate structures.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An inflow control device, comprising:

an upstream flow control structure configured to induce water droplet collisions; and a downstream flow control structure disposed downstream of the upstream flow control structure and comprising a channel formed therethrough, wherein the upstream flow control structure is configured to induce water droplet collisions to form water droplets that have a diameter equal to or greater than a diameter of the channel.

2. The inflow control device of claim 1, wherein the channel is sized to allow oil to pass therethrough.

3. The inflow control device of claim 1, wherein the upstream flow control structure comprises a plurality of impinging jets.

4. The inflow control device of claim 1, wherein the upstream flow control structure comprises a flow baffle.

5. The inflow control device of claim 4, wherein the upstream flow control structure comprises a pressure-dropping structure upstream of the flow baffle.

6. The inflow control device of claim 1, wherein the upstream flow control structure comprises a plurality of pores.

7. The inflow control device of claim 1, wherein the upstream flow control structure and the downstream flow control structure are formed as a unitary structure.

8. The inflow control device of claim 1, wherein the downstream flow control structure has a circular cross-section in a plane perpendicular to a direction of flow.

9. A wellbore system comprising:

a borehole in a subsurface formation;

a string disposed in the borehole; and the inflow control device of claim 1 disposed within or as part of the string.

10. An inflow control device, comprising:

an upstream flow control structure configured to induce water droplet collisions; and a downstream flow control structure disposed downstream of the upstream flow control structure and comprising a channel formed therethrough, wherein the upstream flow control structure comprises a flow baffle, wherein the upstream flow control structure comprises a pressure-dropping structure upstream of the flow baffle, and wherein the pressure-dropping structure comprises a nozzle.

11. The inflow control device of claim 10, wherein the upstream flow control structure is configured to induce water droplet collisions to form water droplets that have a diameter equal to or greater than a diameter of the channel.

12. An inflow control device, comprising:

an upstream flow control structure configured to induce water droplet collisions; and a downstream flow control structure disposed downstream of the upstream flow control structure and comprising a channel formed therethrough, wherein the channel has a diameter between 80 μm and 120 μm.

13. A method of controlling flow comprising:

flowing a fluid from a source to a destination through an inflow control device comprising an upstream flow control structure and a downstream flow control structure disposed downstream of the upstream flow control structure and comprising a channel formed therethrough; and inducing water droplet collisions in the upstream flow control structure, wherein the inducing water droplet collisions in the upstream flow control structure forms water droplets having a diameter equal to or greater than a diameter of the channel.

14. The method of claim 13, wherein the fluid comprises a mixture of oil and water.

15. The method of claim 13, further comprising:

flowing the fluid into the upstream flow control structure at a Reynolds number that is lower than a threshold at which water droplets within the upstream flow control structure undergo shearing.

16. The method of claim 13, wherein the upstream flow control structure comprises a plurality of impinging jets.

17. The method of claim 13, wherein the upstream flow control structure comprises a flow baffle.

18. The method of claim 13, wherein the upstream flow control structure and the downstream flow control structure are formed as a unitary structure.

* * * * *